United States Patent [19]

Koch

[11] 4,131,146

[45] Dec. 26, 1978

[54] HELICAL FLAKING HEAD WITH MULTIPLE CUTTING CIRCLE DIAMETERS

[75] Inventor: Peter Koch, Alexandria, La.

[73] Assignee: The United States of America as represented by the Secretary of Agriculture, Washington, D.C.

[21] Appl. No.: 805,370

[22] Filed: Jun. 10, 1977

[51] Int. Cl.[2] ..... B27C 1/00

[52] U.S. Cl. ..... 144/221; 144/117 B; 144/172; 407/12

[58] Field of Search ..... 144/41, 114 R, 117 R, 144/117 A, 117 B, 130, 162, 172, 218, 221, 230, 323, 37, 39; 90/17, 18, 19; 407/12, 57, 59, 63

[56] References Cited

U.S. PATENT DOCUMENTS

| | | | |
|---|---|---|---|
| 1,126,107 | 1/1915 | Simmons | 407/12 |
| 1,359,179 | 11/1920 | Lassiter | 407/59 |
| 2,315,982 | 4/1943 | Phaneuf | 407/12 |
| 2,620,709 | 12/1952 | Wildhaber et al. | 407/12 |
| 2,898,958 | 8/1959 | Schubert | 144/172 |
| 3,715,788 | 2/1973 | Ayer | 407/63 X |
| 3,785,417 | 1/1974 | Vora | 407/59 |
| 3,798,723 | 3/1974 | Czopor | 407/59 |
| 3,884,281 | 5/1975 | Pepse | 144/172 X |
| 4,046,180 | 9/1977 | Marshall et al. | 144/117 B |

*Primary Examiner*—J. M. Meister
*Assistant Examiner*—W. D. Bray
*Attorney, Agent, or Firm*—M. Howard Silverstein; David G. McConnell

[57] ABSTRACT

A rotative, flaking, cutterhead in the form of a right regular cylinder with surface mounted helical shaped cutting blades. The cutterhead characterized by multiple and progressively increasing cutting blade circle diameters, said blades being closely grouped on said cylinder.

2 Claims, 6 Drawing Figures

SECTION A-A

HELICAL FLAKING HEAD WITH MULTIPLE CUTTING CIRCLE DIAMETERS

BACKGROUND OF THE INVENTION

1. Field of the Invention

This invention relates to an apparatus for milling lumber. More specifically, it relates to cutterhead design for flake-cutting.

2. Prior Art

Simpler cutterhead designs have been proposed by others; for example, those helical cutterheads which cut on a common cutting circle. (See Stewart, H. A., "Chips produced with a helical cutter," *Forest Products Journal* 21(5):44; and Stewart, H. A., and Lehmann, W. F., "Crossgrain cutting with segmented cutters produces good surfaces and flakes," *Forest Products Journal* 24(9) :104.) Another previous cutterhead design is that of D. L. Schubert (see U.S. Pat. No. 2,898,958).

Headrig and edger chippers cutting in the 90-0 and 90-90 modes are in widespread use if softwood mills of North America (Koch, P., "Utilization ofthe Southern Pines," USDA Agriculture Handbook 420, p. 836) and to a lesser extent throughout the rest of the world. They have been adopted because of their productivity per man-hour and because they make no sawdust.

Because their peripheral-milling and end-milling cutterheads take large bites per tooth to make pulp chips ⅝- to ⅞-inch in length, they tear out grain around knots and tend to splinter board edges. Resultant surfaces display torn grain extending perhaps ⅛-inch into board face or edge.

These torn rough lumber surfaces can, for the most part, be smoothed if planers are adjusted to remove about ⅛-inch from board faces and edges. Because of the low value of planer shavings, lumbermen are reluctant to take this remedial action, however.

It therefore appears virtually mandatory that the next generation of chipping headrigs and chipping edgers be equipped with cutterheads that leave smooth surfaces. Mills equipped with such cutterheads acting in concert with multiple bandsaws can produce quality lumber with minimum labor input, and minimum output of low-value sawdust and shavings.

SUMMARY OF THE INVENTION

The purposes of this invention are to provide a device and method for smoothing lumber to finished dimension following machining by a headrig or edger chipper; to substantially improve the quality of cross-cut wood flakes produced in the lumber milling process so that flakes are of optimum or near optimum shape for use in the manufacture of structural flakeboard; and, to reduce significantly the waste of natural materials and convert what would otherwise be waste material of little economic value into a marketable commodity.

The concept proposed is simple. Immediately following each headrig (or edger) chipping cutterhead would be a varible or constant speed cylindrical, helical bladed smoothing head, located as suggested over a decade ago by Koch (see Koch, P., "Square cants from round bolts without slabs or sawdust," *Forest Products Journal* 14:332–336, 1964). This flaking head, designed to leave smooth surfaces, would be arranged to cut veneer-like particles in the manner of a veneer slicer. The device utilizes helical cutting edges of progressively greater radii attached to a rotating cylinder whose axis is fixed in a vertical plane parallel to the workpiece movement but which is raised at an angle to the feed direction of the workpiece movement (within the parallel plane). The advantage of the instant invention over all previous designs is apparent from the vastly superior cross-cut flakes produced; their superiority is due to the fact that the flakes resemble small pieces of thin veneer with cut surfaces essentially parallel to the grain. Depth of cut of the flaking head would be readily adjustable to ensure a smooth finish free of torn grain caused by the chipping head. The arrangement of the cutterhead knives about the cylinder surface is characterized by a sequential and progressively increasing knife height relative the cylinder surface, each knife rotationally behind the shortest knife exhibiting an increased knife blade exposure.

DESCRIPTION OF PREFERRED EMBODIMENTS

Figure 1A:
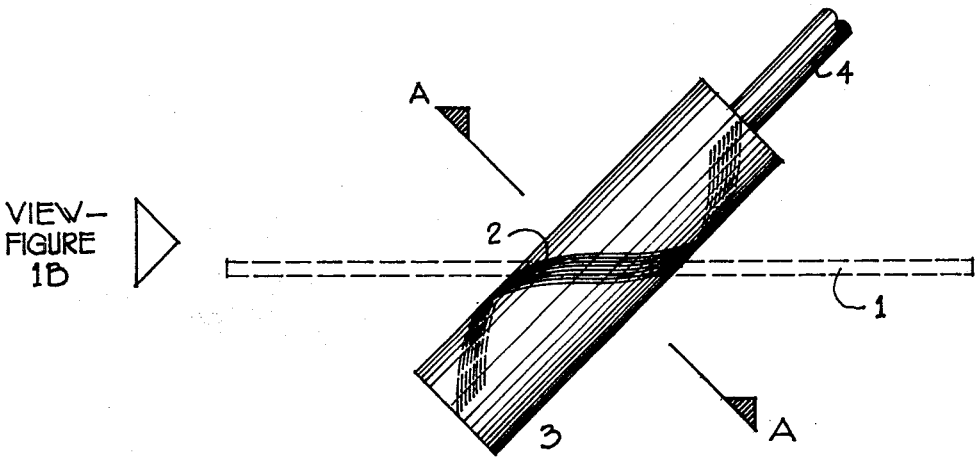
FIG. 1*a* is a side view of the helical flaking head showing its position relative to the moving workpiece.

FIG. 1*a* is a side view of the helical flaking head with multiple cutting circle diameters as it adresses the workpiece 1. The view looks through the workpiece 1, which is moving right to left. The major elements of the invention are evident. Specifically, a plurality (eight shown) of closely-grouped, uniformly spaced, severally parallel, bladed, continuous cutterhead knives 2, each mounted as approximately one full turn about the surface of a rigid, right regular cylinder 3 axially rotatable, axially drivable, axially mounted and supported from at least one cylinder end, thereby to define upon the cylinder surface a corresponding plurality of 45° helices. The flaking head is driven via a means 4 for driving and supporting the said cylinder adapted to axially rotate the cylinder and associate blades at an operator-selected variable or constant peripheral speed while positionally maintaining the axis of rotation at an angle of 45° relative the direction of feed.

Figure 1B:
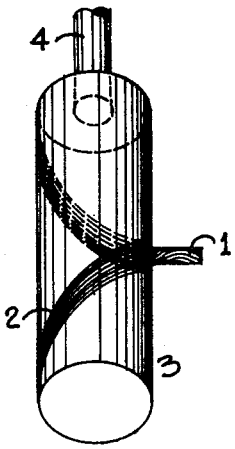
FIG. 1*b* is a front view of the helical flaking head showing its position relative to the moving workpiece.

FIG. 1*b* is a front view of the invention looking from the workpiece destination to the workpiece feed. Naturally, in this view the workpiece 1 is moving in the direction of the viewer, having just left the invention's knives. The eight knives 2 can be clearly seen as they wrap one full turn around the steel cylinder 3 in a 45° helix. Rotation is in clockwise fashion as noted.

Figure 2A:
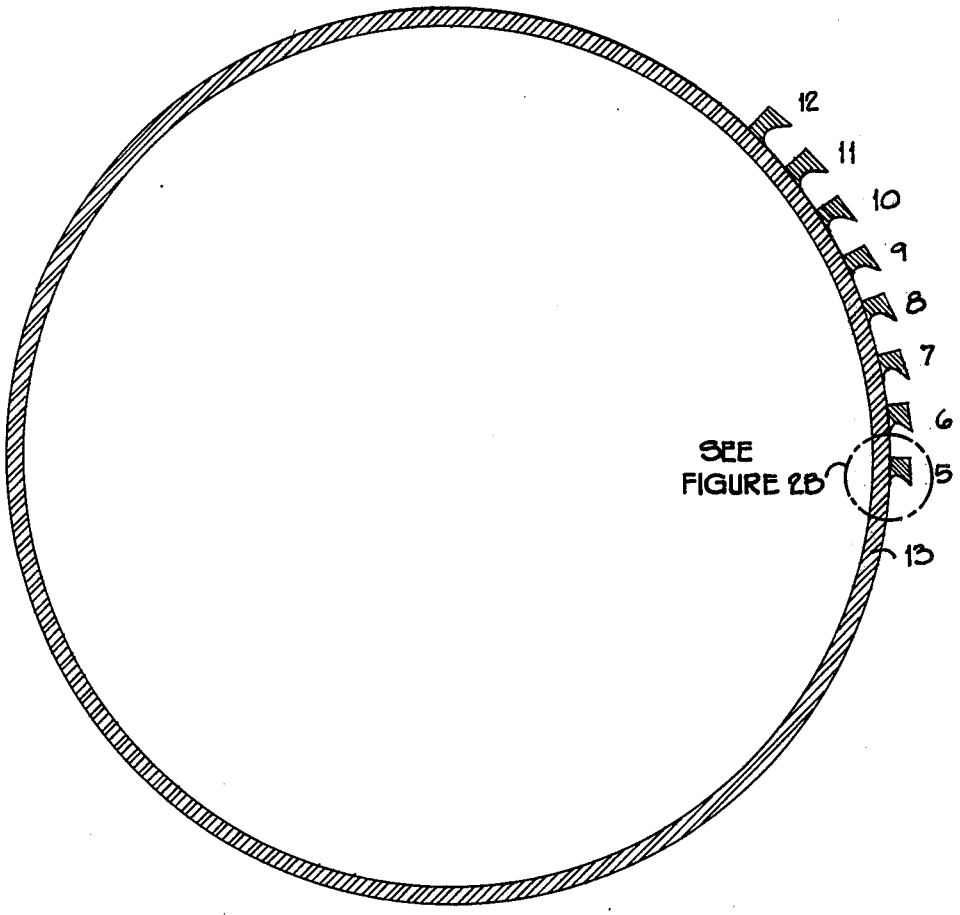
FIG. 2*a* is a cross section (as identified, "Section A—A") of the helical flaking head.

FIG. 2*a* illustrates the placement of the eight knives 5–12 on the cylinder 3. All knives are of same basic configuration (see FIG. 2*b* ) but are in an order of increasing height from the cylinder surface 13. Following the clockwise cylinder rotation, as shown by directional arrow 13, the first knife to engage the workpiece is noted, 5. That first knife 5 has an initial height at its front cutting edge of approximately 0.250 inches above the cylinder surface 13. Each knife in succession rises approximately an additional 0.015 inches above the cutting radius of its predecessor, so that the cutting edge heights are approximately as follows (in the proper sequence of engagement with the workpiece):

(6) 0.265 inch
(7) 0.280 inch
(8) 0.295 inch
(9) 0.310 inch
(10) 0.325 inch
(11) 0.340 inch
(12) 0.355 inch Thus the first knife has a cutting radius of approximately 6.250 inches while the last knife's radius is about 6.355 inches. As shown in a cross sectional FIG. 2A blades 5 through 12 are closely grouped in a manner such that a separation exist between the trailing edge of highest blade 12 and the leading edge of lowest blade 5. This separation constitutes from about 3/6 to 5/6 of the cylender periphery at the cross section. This is true at any cross section of the cylinder.

Figure 2B:
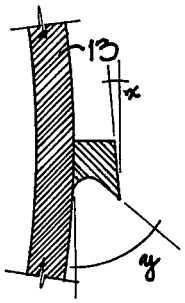
FIG. 2*b* is a detail of a typical knife section (initial blade used as illustration).

FIG. 2*b* shows the knife configuration detail. The blade illustrated is the intital engaging knife (see FIG. 2*a*(5)) but the blade construction geometry is identical on all knives remembering, of course, the successive increases in height above the cylinder surface. The cutting edge of each knife is about 0.015 inch greater in radius than its immediate predecessor. In particular description, the rear of the top face of each is canted toward the surface of the cylinder approximately 5° from a line parallel to the cylinder surface 13 tangent at that point (angle *x*). The top face itself is about ⅜ inch in width. The cutting edge of the blade is comprised of an addressing face which maintains a constant angle (about 45°) relative to the cylinder's surface 13 tangent (see angle *y*). Knives can be constructed of any appropriate material such as high-speed steel or carbide alloy.

Figure 3A:
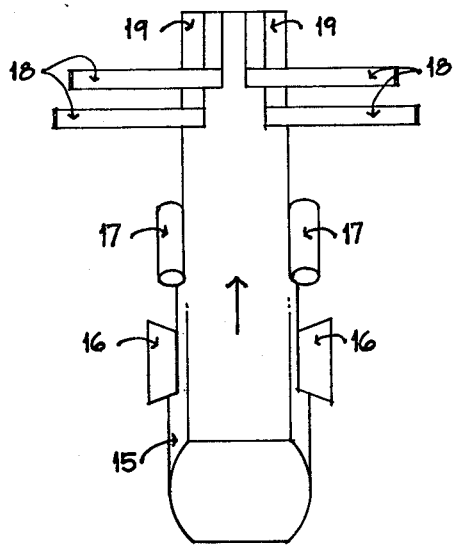
FIG. 3*a* illustrates the placement of the helical flaking heads following the headrig chipper heads in a standard lumber mill operation.
Figure 3B:
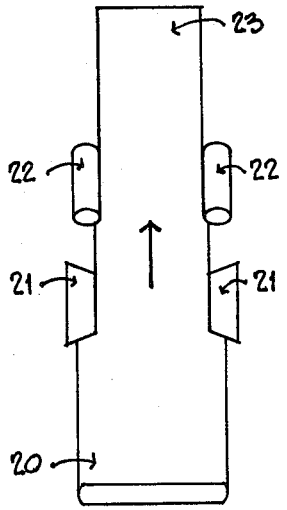
FIG. 3*b* shows the placement of the helical flaking heads following the chipping edger heads in a standard lumber mill operation.

FIGS. 3*a* and 3*b* illustrate the location of the helical flaking head with multiple cutting circle diameters within the lumber mill finishing process. In FIG. 3*a* a plan view is shown with the log (or previously slabbed cant) 15 engaged first by either the opposed end-milling or the peripheral milling chipping heads 16 which immediately precede engagement by the invention 17. Next in the process are the quad shiftable bandsaws 18, after which the workpiece 15 continues through the standard lumber milling process, with the newly-milled sideboards 19 having one smoothly planed surface and one sawn surface.

Similarly, FIG. 3*b* shows the invention's location within the edging operation where a wavy-edged board 20 enters the system and is first met by the edger chipping heads 21, followed by the helical flaking heads with multiple cutting circle diameters 22 to yield a board with smoothly planed edges 23. Not only is the lumber milled at this point, but also the invention has produced cross-cut flakes of optimum design for further manufacturing usage.

Having thus described my invention I claim:

1. In a cutter head apparatus for milling a planar piece of lumber and simultaneously producing wood flakes therefrom the improvement wherein said apparatus comprises:

(a) a cylinder;
(b) means attached to said cylinder at one end to rotate said cylinder and to support said cylinders at an angle to the planar piece of lumber;
(c) a plurality of cutter knives mounted on the surface of said cylinder in a manner such that said cutter knives form a plurality of uniformly spaced, parallel, continuous helicles around said cylinder, said plurality of cutter knives being characterized by a sequential and progressively increasing knife height relative the cylinder surface, said plurality of cutter knives being closely grouped in a manner such that at any given cross section of said cylinder the separation between the trailing edge of the highest knife and the leading edge of the lowest knife constitutes from about 3/6 to 5/6 of the cylinder periphery.

2. The flaking head of claim 1 wherein each knife in succession rises approximately an additional 0.015 inches above the cutting radius of its predecessor, so that the cutting edge heights above the surface of said cylinder are approximately as follows (in proper sequence of engagement with the workpiece):

initial blade 0.265 inch
second blade 0.280 inch
third blade 0.295 inch
fourth blade 0.310 inch
fifth blade 0.325 inch
sixth blade 0.340 inch
seventh blade 0.355 inch.

* * * * *